United States Patent [19]

Gerrick

[11] 4,344,203

[45] Aug. 17, 1982

[54] PORTABLE GOLF BALL WASHER

[76] Inventor: Richard L. Gerrick, 125 Woodland View, York, Pa. 17402

[21] Appl. No.: 230,878

[22] Filed: Feb. 2, 1981

[51] Int. Cl.[3] ..... A63B 47/04

[52] U.S. Cl. ..... 15/21 A; 15/97 R

[58] Field of Search ..... 15/21 A, 97 R

[56] References Cited

U.S. PATENT DOCUMENTS

| | | | |
|---|---|---|---|
| 1,747,724 | 2/1930 | Mollart | 15/21 A |
| 2,807,037 | 9/1957 | Garske | 15/21 A |
| 3,101,497 | 8/1963 | Derkocz | 15/21 A |
| 3,583,016 | 6/1971 | McConnell | 15/21 A X |

FOREIGN PATENT DOCUMENTS

| | | | |
|---|---|---|---|
| 630349 | 5/1936 | Fed. Rep. of Germany | 15/97 R |

*Primary Examiner*—Robert L. Bleutge
*Attorney, Agent, or Firm*—C. Hercus Just

[57] ABSTRACT

A portable golf ball washer comprising a vertical cylindrical container closed at the bottom and open at the top and lined with a piece of stiff bristled carpet having the bristles to extend inwardly and the tips defining a core hole of less diameter than that of a golf ball to be scrubbed, a plunger having one end comprising a handle extending beyond the open end of said container when fully inserted, and the other end of said plunger having a U-shaped bail-like ball-retaining member of wire formed into a circular portion extending around a ball when contained therein for more than 180 degrees of the circumference and the legs of said member being parallel and terminating in inwardly projecting ends inserted into the sides of the other end of said plunger.

2 Claims, 4 Drawing Figures

PORTABLE GOLF BALL WASHER

BACKGROUND OF THE INVENTION

For a number of years, golf courses have provided golf ball washing equipment, especially at the Club House, and also at certain locations around the course, which are of a stationary nature, usually supported by a post, one common form of washer comprising a cylindrical container four or five inches in diameter and having a pair of scrub brushes fixed within the container with the bristles toward each other, and a board having a hole therein slightly larger than the diameter of a golf ball is moved longitudinally between said pair of scrub brushes with the ball inserted within the hole, the container usually containing water. Apparatus of this type is highly unsuited for portable use and it is not infrequent that it is desirable to wash a golf ball when not in the locality of a stationary type of ball washer, especially if a ball lands in a muddy spot, for example, whereby some thought has been given heretofore to providing portable type golf ball washers that might be attached to a golf cart, golf bag or wheel-type bag holders that are manually pulled by a golfer.

One such attempt to provide a portable golf ball washer of the type referred to immediately above comprises the subject matter of prior U.S. Pat. No. 3,101,497 to Derkocz, dated Aug. 27, 1963. The structure shown therein is adapted to be mounted upon a tubular member of a golf cart, for example, but the element therein which holds the ball for reciprocation within the container to have the ball engage bristles therein comprises a screw cap capable of preventing spilling of the washing fluid from the container during operation of the cart.

SUMMARY OF THE INVENTION

It is among the principal objects of the present invention to provide a portable golf ball washer which readily may be attached to a golf bag, golf cart, either hand-pulled or power-operated, and includes a bracket readily attachable to any strut-like member of a golf bag or cart and be suspended therefrom pendulum-like to prevent spilling of the washing fluid, and further to assist in maintaining the washing fluid within the container, the washer of the present invention includes a cylindrical container in which bristles of uniform length project radially inward from the inner walls of said container and the tips of said bristles define a cylindrical space, the cross-sectional area of which is substantially equal to the cross-sectional area of a plunger insertible longitudinally within the container and having on the lower end thereof a bail-type holder, the legs of which are parallel and extend upward along the lower portion of the plunger and are secured thereto, while the lower bight portion is substantially circular for greater than 180 degrees to define a partial ring of slightly greater inner diameter than the outer diameter of a golf ball, which diameter, incidentally, is greater than the diameter of the central cylindrical opening defined by the tips of the bristles, and the cross-sectional dimension of the plunger also being less than the diameter of the golf ball, whereby the arrangement of the tips of the bristles and the bail-like member assure scrubbing and washing of the ball incident to reciprocably moving the plunger in opposite directions within the cylindrical opening formed by the tips of the bristles within the container.

It is another object of the invention to form said bristles from a piece of carpet having backing which is rectangular in shape and is as long as the interior length of the container and as wide as the dimension of the inner circumference of the container, whereby said carpet may be formed into a cylindrical shape and inserted within the container, the resilience of the backing normally being sufficient to maintain the circularly arranged piece of carpet within the container with the bristles extending radially inwardly and the upper end of the container having a narrow circular transverse flange which serves to maintain the piece of bristled carpet operatively within the container during operation of the plunger.

It is a further object of the invention to form the plunger from wood, the same being either square or circular in cross-sectional shape, and the section thereof including the bail-like member which is inserted within the container has an upper end which projects a reasonable distance, such as of the order of three inches above the upper end of the container when the plunger and bail-like member, together with the ball, are fully inserted into the container, whereby the entire combination is light in weight, simple in construction, and inexpensive to construct.

Still another object of the invention is to form the bail-like member from preferably rustproof wire, and the major portion of the parallel legs of the bail-like member are inserted within longitudinally extending grooves in the lower end of the plunger and the terminal ends of the bail-like member are bent at a right angle to said legs and are disposed into holes extending radially into the sidewalls of the plunger, the wire preferably being of a stiff nature and adapted to hold the intended shape.

A still further object of the invention is to provide a disc of suitable cushion material, such as rubber or the like, in the central portion of the bottom of the container to prevent damage to said bottom, incident to reciprocating the plunger with a ball on the inner end thereof during the washing operation.

Details of the foregoing objects and of the invention, as well as other objects thereof, are set forth in the following specification and illustrated in the accompanying drawing comprising a part thereof.

DETAILED DESCRIPTION OF THE PREFERRED EMBODIMENT

Figure 1:
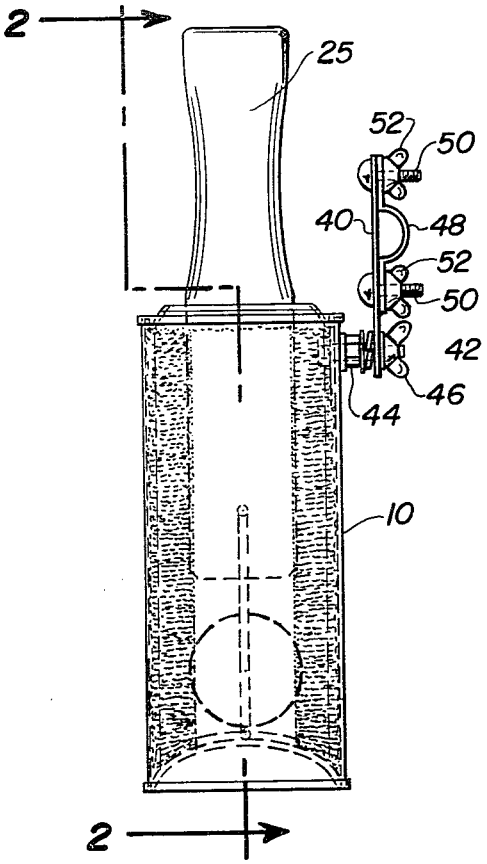
FIG. 1 is a side elevation of a container with a plunger shown therein in fully inserted condition and having an attachably bracket, all of which constitutes part of the present invention.

Referring to FIG. 1, the portable golf ball washer comprising the present invention consists of a portable cylindrical container 10 having an integral bottom 12 which closes that end of the container and the top of the container 10 has an opening 14 defined by the rim of a narrow radially extending flange 16. The scrubbing means for the container comprises a substantially rectangular piece of bristled carpet, preferably of a waterproof nature, including the bristles, and said bristles 20 being of substantial length, such as of the order of three-eighths of an inch to one-half inch, attached to a flexible backing 18 from which the bristles 20 project radially inward. It is to be understood that the aforementioned exemplary dimensions are intended to be illustrative rather than restrictive. Also, the tips of the bristles define a central cylindrical hole having a diameter less than the diameter of a golf ball to be scrubbed, whereby effective engagement of the tips of the bristles with the golf ball is assured. An exemplary illustration of the relative dimensions of the bristles and the golf ball 22 is shown in FIG. 2, relative to opening 14.

Figure 2:
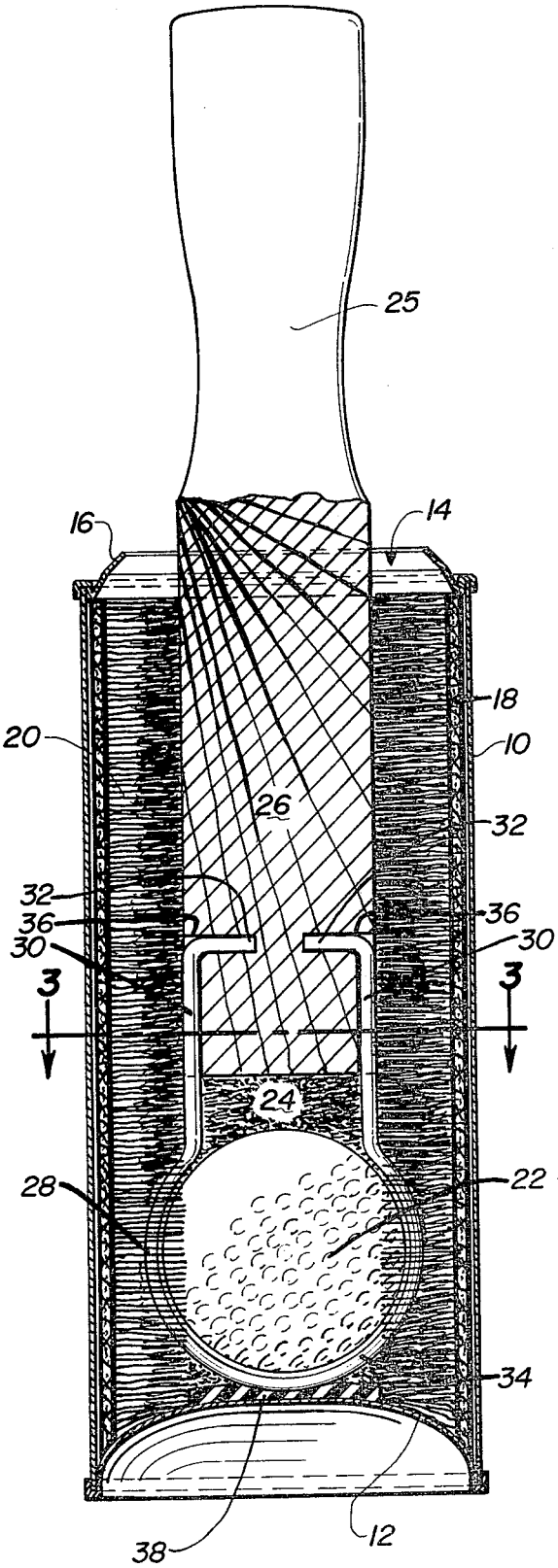
FIG. 2 is a vertical longitudinal sectional view of the container and plunger, shown in FIG. 1 as seen along the line 2—2 thereof, the plunger and golf ball not being shown in section.
Figure 3:
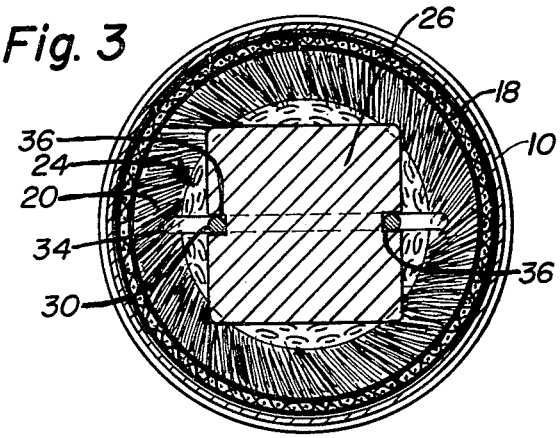
FIG. 3 is a transverse sectional view of the arrangement shown in FIG. 2, as seen on the line 3—3 thereof.
Figure 4:
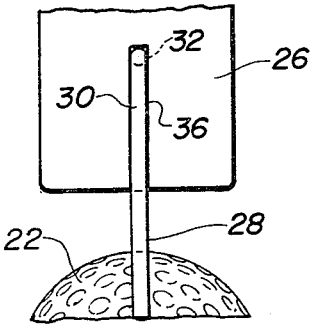
FIG. 4 is a fragmentary side elevation, showing the means for attaching the bail-like member to the lower end of the plunger, as seen from one side of the plunger and bail-like member, as shown in FIG. 2.

Movement of the ball within the cylindrical hole 24 formed by the tips of the bristles, as shown at least partially in FIG. 2 immediately above the ball 22, is effected by a plunger 26, which preferably is of uniform cross-sectional shape for the major portion of the length thereof, as shown in FIG. 2, and also having a projecting outer end comprising a handle 28, which has a shape readily engaged by a human hand. As shown in FIG. 3, the plunger 26 is illustrated as being square with somewhat rounded corners, but if desired, the same may be cylindrical or some other geometric shape in cross-section but preferably, in accordance with the present invention, it is desired that the cross-sectional area of the plunger 26 be substantially equal to or slightly greater than the cross-sectional area of the central hole 24 formed by the tips of the bristles when in repose without the plunger being inserted therein, for reasons given below.

For purposes of supporting a ball in operative scrubbing relationship relative to the bristles, the plunger 26 is formed on the inner end thereof with a U-shaped bail-like ball-retaining member 28 having parallel legs 30, the terminal ends 32 of which are bent at a right-angle toward each other, as shown in FIG. 2, the distance between the legs 30 being less than the inner diameter of the circular portion 34, which has an inner diameter a little greater than the diameter of the ball 22 to be engaged thereby but the distance between the legs 30 being less than the diameter of the ball 22, whereby when the plunger is moved downwardly, movement of the ball 22 toward the bottom 12 of the container will be assured. However, the clearance between the ball and the inner diameter of the circular portion 34 of the bail-like member 28 insures rotating movement of the ball while being washed so as to have all surfaces thereof engage the bristles 20.

For purposes of effective but inexpensive manufacture, it is preferred that the retaining member 28 be formed of stiff wire of approximately one-eighth inch in diameter, although this dimension is not intended to be restrictive, but merely illustrative. To accurately position the legs 30 and terminal ends 32 operatively with the inner end of the plunger 26, opposite sides of the plunger 26 are provided with shallow grooves 36, having a depth substantially equal to the diameter of the wire from which the legs 30 are formed, and the stiffness of the wire suitably retaining the legs 30 within the grooves 36, said grooves terminating at the their inner ends in inwardly extending holes in which the terminal ends 32 of the legs 30 are inserted forcibly for firm attachment.

From such description, it will be seen that the plunger and the ball-retaining member thereon can be manufactured very simply and inexpensively, in addition to the container 10 and the bristled carpet scrubbing member also being inexpensively manufactured.

For purposes of preventing injury to the bottom 12 of the container during the reciprocation of the plunger 26 and the ball-retaining member 28, a disc or other suitable shape of cushion 38 formed of rubber or otherwise, is attached to the inner surface of bottom 12 for engagement by the innermost end of the circular portion 34 of the ball-retaining member 28.

For purposes of supporting the container 10 in pendant-like manner from a portion of a golf bag or cart to which it is attached, a bracket 40 is pivotally connected to a bolt 42, the head 44 of which, for example, is suitably affixed to the upper portion of the outer surface of container 10, as shown in FIG. 1, by welding or otherwise, and the end of the bracket member 40 attached thereto has a hole through which the bolt 42 extends for attachment of a wing nut 46 thereto. Preferably, the connection is sufficiently loose that ready pivoting of the container 10 with respect to the bracket 40 may occur during use.

The bracket also includes a bail-type securing member 48 attached by bolts 50 and wing nuts 52 to the outermost surface of the bracket 40 for suitable connection to any strut-like means of a golf bag or golf cart for support in pendant-like manner.

In operation, the golf ball 22 is inserted through the circular portion 34 of the ball-retaining member 28, which circular portion extends around the ball for substantially greater than 180 degrees and while holding the ball within the retaining member 28, said member and the ball on plunger 26 are inserted through the opening 14 in the top of the container 10 for downward movement, followed by reciprocatory movements within the washing fluid, such as water and/or detergent contained within the bristled interior of the container 10. Also, as referred to above, it is preferred that the cross-sectional area of the plunger 26 is at least equal to or greater than the cross-sectional area of the circular hole defined by the tips of the bristles 20, whereby the plunger 26 somewhat functions in the capacity of a stopper to prevent spilling the washing fluid from the interior of the container 10 during operation and also while the container is being transported on a golf bag or cart. Suitable reciprocation of the plunger with the golf ball 22 occurs until sufficient cleaning has taken place, after which the plunger is removed through the opening 14 and carries the ball 22 with it for removal from the plunger. The plunger then is reinserted in the circular hole defined by the tips of the bristles 20 until further use is desired.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A portable golf ball washer comprising an elongated cylindrical container closed at one end comprising a bottom and open at the opposite end normally comprising the top, scrubbing bristles extending a predetermined uniform distance inwardly from the entire inner surface of said container, the tips of which in repose define a core hole of a diameter less than that of a golf ball to be scrubbed by said bristles, an elongated plunger having a length greater than that of said container and a cross-sectional area similar to that of said core hole and a transverse dimension less than the diameter of a golf ball, one end of said plunger being a handle projecting beyond the open end of said container when said plunger is inserted to maximum extent therein and is manually engageable for operation of the washer, and the opposite end of said plunger having a U-shaped bail-like ball-retaining member substantially circular for more than 180° of the circumference thereof and dimensioned to closely but loosely surround a golf ball to effect movement thereof relative to said bristles when said plunger is reciprocated axially, and the legs of said bail-like member being parallel and fixed to said opposite end of said plunger within grooves formed longitudinally in the opposite sides thereof to maintain said member in axial alignment with said plunger and the diameter of the portion of said bail-like member which is circular having a diameter greater than the transverse dimension of said opposite end of said plunger to effect efficient exposure to the surface of a ball within said member to the bristles within said container.

2. The washer according to claim 1 further including a bracket attachable to a golf cart or the like, a freely pivoted connecting means attaching said bracket to the upper end of the container of said washer to insure free pendant-like swinging of said container in all normal positions of such a cart, and said plunger when inserted in said container substantially filling the core hole defined by the tips of the bristles and thereby functioning to minimize the possible escape of washing fluid from said container in the event of accidental tipping of said container.

* * * * *